United States Patent [19]

Wood et al.

[11] 4,323,894

[45] Apr. 6, 1982

[54] CIRCUIT FOR DRIVING ELECTROMAGNETICALLY-ACTUATED DISPLAYS

[76] Inventors: William D. Wood, 141 - 22nd St., Del Mar, Calif. 92014; Kenneth L. Davidson, 2320-1/2 Brant St., San Diego, Calif. 92101

[21] Appl. No.: 148,386

[22] Filed: May 9, 1980

[51] Int. Cl.[3] ..... G09G 3/20

[52] U.S. Cl. ..... 340/764; 340/373; 340/813

[58] Field of Search ..... 340/373, 764, 813

[56] References Cited

U.S. PATENT DOCUMENTS

| | | | |
|---|---|---|---|
| 4,069,480 | 1/1978 | Helwig | 340/764 X |
| 4,178,575 | 12/1979 | Ono | 340/764 |
| 4,250,504 | 2/1981 | Eichelberger | 340/813 X |

*Primary Examiner*—David L. Trafton

*Attorney, Agent, or Firm*—Frank D. Gilliam

[57] ABSTRACT

A circuit to drive electromagnetically actuated displays. The circuit maintains a precise current level regardless of variations in supply voltage and drive coil resistance. The inductance of the drive coil is utilized to increase the efficiency of the current control.

4 Claims, 5 Drawing Figures

10

CIRCUIT FOR DRIVING ELECTROMAGNETICALLY-ACTUATED DISPLAYS

BACKGROUND OF THE INVENTION

Electromagnetically-actuated displays generate a desired digit character or pattern by selectively positioning individual elements of the display to visible or non-visible orientations. The positioning mechanism is the inertreaction of a magnet with a magnetic field created when a drive coil is energized. A minimum current is required to position the element and a drive circuit must provide that minimum over the range of operating voltage and changes in drive coil resistance due to temperature variations. Normally such drive circuits provide the minimum current under the worst conditions, but much higher currents under normal or more favorable conditions. The resulting waste of energy is undesirable when operating from batteries and/or from expensive solar cells, etc. Thus for those and similar applications it is desirable to control the drive currents in an efficient manner.

The characteristics of this invention are that it controls these drive coil currents to the required level and excess available drive voltage is efficiently utilized through a current transformation in that average coil currents are greater than the average current into the drive circuit.

SUMMARY OF THE INVENTION

In a preferred embodiment of the invention, when the circuit is energized and a drive signal from an external control causes the circuit to apply voltage to the selected display element drive coil, the drive current builds up against the inductance of the drive coil until it has attained the desired level, at which time the external control turns off its drive signal which in turn causes the circuit to remove the drive voltage from the coil. The inductance of the coil then maintains an exponentially decaying drive current until it falls to a predetermined level at which time the external control resumes the drive signal, the voltage source is reapplied, and the sequence is repeated. Thus drive currents fluctuate closely around the desired level and energy input from the voltage source is efficiently utilized.

The higher the source voltage and the lower the drive coil resistance, the more rapid is the current buildup and the shorter is the voltage "on" time, thus conserving the energy source. Conversely, the lower the voltage and the higher the coil resistance, (i.e., due to internal heating and or higher ambient temperatures) the longer is the voltage "on" time, thus assuring the minimum required drive currents under less favorable conditions. In effect, the circuit utilizes the inductance of the drive coil to operate as a switching current regulator, and, as in the case of a switching voltage regulator, the circuit achieves a current transformation in that the average coil drive current is greater than the average current drain from the energy source.

In a particular preferred embodiment of the invention for the drive of several multi-element characters in a single display, the element drive circuits are multiplexed so as to drive only one character at a time as selected by a character drive transistor. The character drive transistor also is switched to regulate the element drive coil currents, thus reducing power loss and expense over a circuit with a single-function and separate regulating device.

BRIEF DESCRIPTION OF THE DRAWINGS

The advantages of the invention reside in the construction and cooperation of the parts hereinafter described, reference being made to the accompanying drawings forming a part of this disclosure, wherein a preferred embodiment of the invention is shown by way of an example and wherein like reference numerals depict like parts or elements throughout the various figures.

DESCRIPTION OF THE PREFERRED EMBODIMENT

Figure 1B:
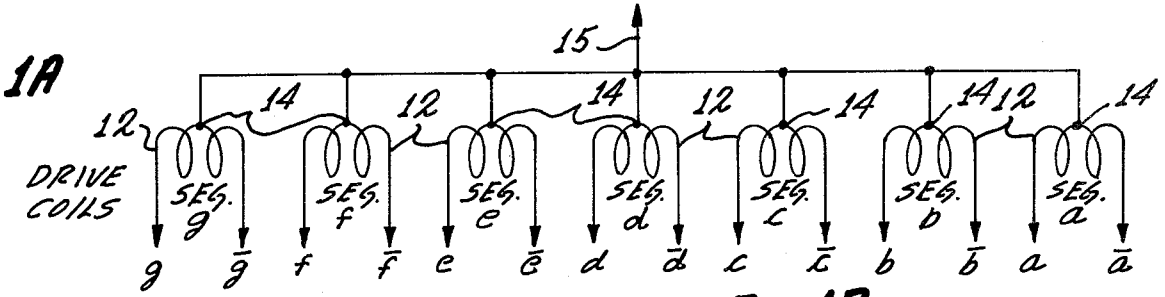
FIG. 1B is a detailed showing of the drive circuits for the display character of FIG. 1A.
Figure 1A:
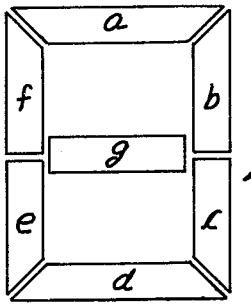
FIG. 1A shows a typical seven-segment display character to be driven by the circuit of the instant invention.

Referring to the FIGS. 1A and B, there is illustrated one of many typical configurations and wirings of electromagnetically actuated displays—in this case a seven-segment character 10 that displays any digit 0 to 9 by selective flipping of the digit segments a, b, c, d, e. Each segment includes a drive coil 12 which is center-tapped and the direction of the drive (magnetic field) is determined by whether current is driven through its "on" or "off" windings (g or g, f or f, etc., respectively) to the center tap 14 which is connected to bus 15 is common with all segments of that digit. Once a segment is driven to an "on" or "off" position, it will magnetically latch due to the permanent magnetism of its rotor, and no continuation of drive current is required. For a typical segment to be driven by the circuit described herein the current pulse is 160 ms. in duration at 500 ma. requiring 6 volts across the appropriate 12 ohm coil.

Figure 2:
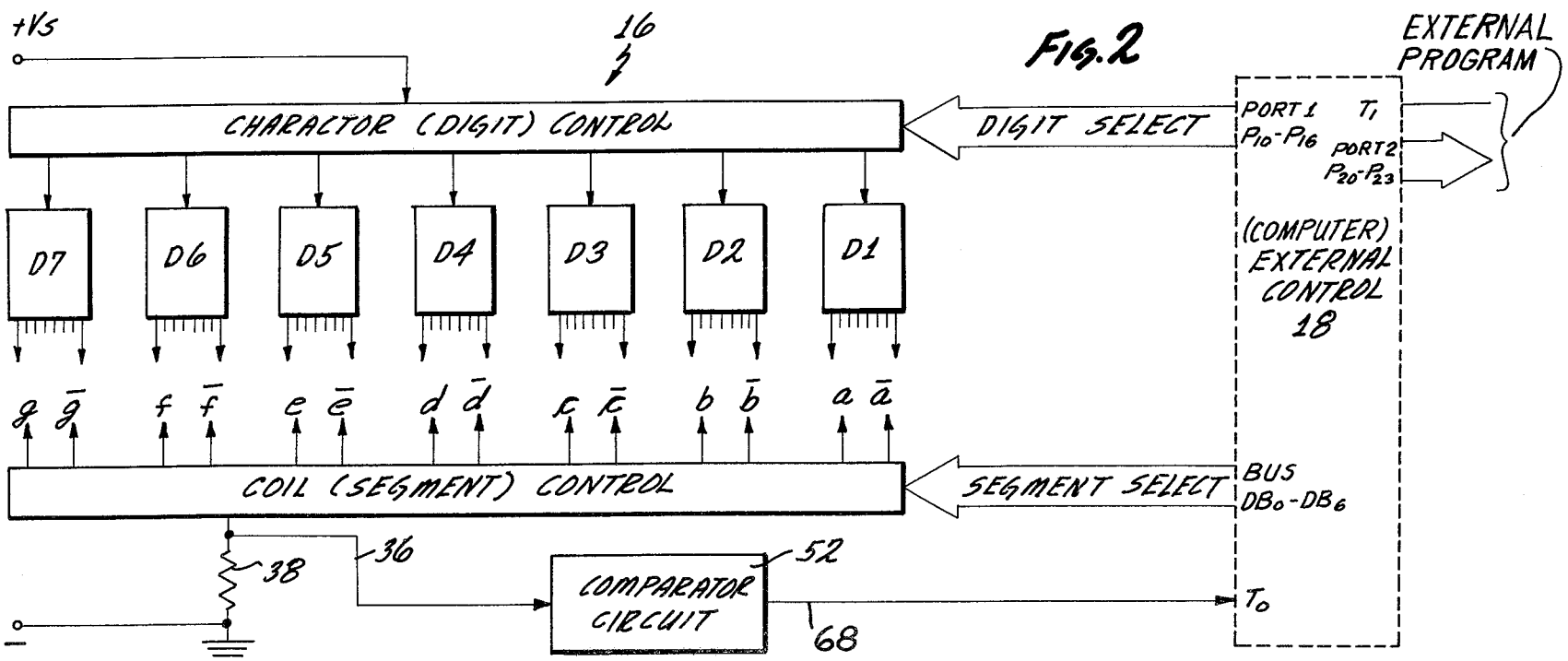
FIG. 2 is a block diagram of the circuit of the instant invention.

FIG. 2 is a block diagram of a preferred embodiment of the drive circuit 16 for a display comprised of seven characters 10, e.g., seven digits configured and wired as described in FIG. 1A and 1B. An unregulated voltage source ($V_S$), for example, a battery (or any suitable source) supplies current to the coils 12, e.g., segments of one single digit at a time in response to signals from external control 18 (shown in block by way of example and not by way of limitation an Intel Computer 8748 or equivalent interconnected and programmed in conventional known manner to perform the functions described herein through its various terminals). The drive circuit outputs provide a current level sense to the external control through a comparator circuit 52.

Figures 3A, 3B:
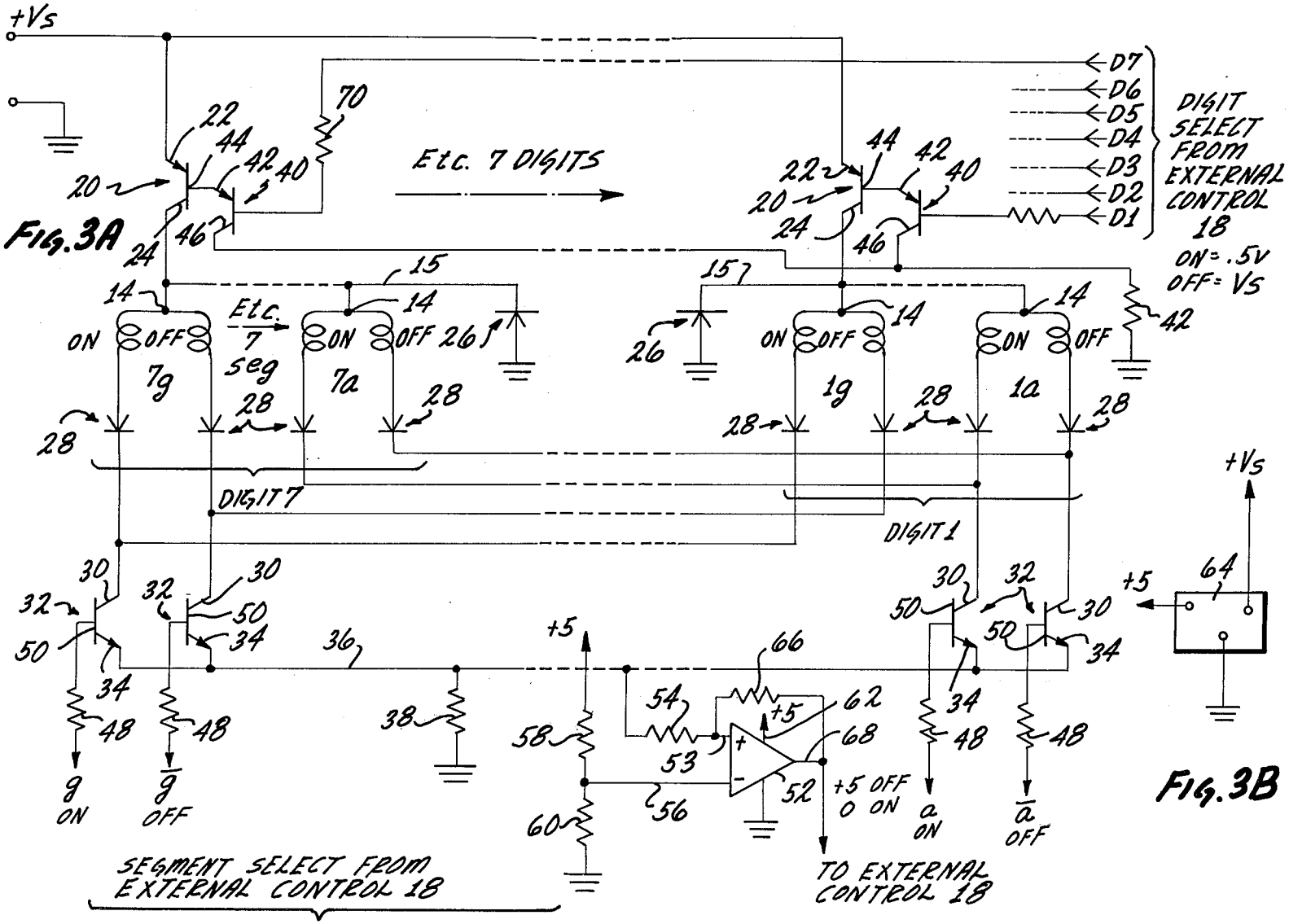
FIG. 3A is a drive circuit schematic for driving the seven-segment display of FIG. 1 (showing two typical segments)
FIG. 3B is a typical regulated power supply.

Referring to FIG. 3A, there is seen a drive circuit schematic for the set of seven (7) digits 10 as described above (only two are shown). Signals from the external control 18 (Port 1 of an Intel Computer 8748) drive the segments a-g of one digit at a time consecutively whenever a digit display is to be changed. It can be seen that each digit drive transistor 20 of the RCA type 41501 or equivalent has its emitter 22 connected to voltage source +vs. and its collector 24 connected to the segment drive coil common center tap 14 for that digit. The collector 24 also is connected to ground through a diode 26 of the Motorola type MBR 120P or equivalent facing in the direction of conventional current flow from ground. Each segment ON and OFF coil is connected through an isolation diode 28 of the type 1N 4002 or equivalent to the collector 30 of its corresponding segment drive transistor 32 of the type RCA type 41500 or equivalent, the emitter 34 of which is connected to a return bus common 36 to all the segment transistor emitters. This bus 36 in turn connects to ground through a 0.1 ohm current sense resistor 38. External control signals for the digit drive transistors 20 input on seven (7) lines connected one each to 1000 ohm resistors which in turn connect to the bases of the buffer transistors 40 of the type 2N 4402 or equivalent, which have their emitters 42 connected to the bases 44 of the digit drive transistors 20 and the collectors 46 of the buffer transistors 40 are connected by a common bus to ground through a common 40 ohm resistor 42. External control signals from external control 18 (Bus $DB_0$–$DB_6$ of an Intel Computer 8748) for the segment drive transistors 32 input on fourteen (14) lines of seven pairs, each pair being a complementary ON or OFF control for each of the seven segments. These lines each connect through a 500 ohm resistor 48 to the base 50 of one segment drive transistor 32.

A comparator 52 of the RCA type CA 339A or equivalent has its positive input 53 connected through a 500 ohm resistor 54 to the return bus end of the resistor 38. The negative input 56 of comparator 53 connects to a voltage divider comprising a resistor 58 of approximately 930 ohms and a resistor 60 of approximately 76 ohms across the +5 volts source and a regulated +5 volts 62 and ground. A regulated +5 volts is supplied by a type 7805 regulator 64 from the $V_s$ supply (see FIG. 3B). A resistor 66 of approximately 72K ohms ties the comparator output 68 back to the positive input 53, and the output 68 also is connected out to the external control 18.

Referring again to FIG. 3A, a suitable voltage for example 12 volts ($V_s$), is applied across emitters 22 and ground of the digit drive transistor 20. Current begins to flow when both an external digit control signal from external control 18 to one of the digits pulls base current through the 1000 ohm resistor 70 and turns on the buffer transistor 40 which turns on the digit drive transistor 20 and an external segment control signal from external control 18 to each segment control line pair turns on either the ON or OFF segment control transistor 32 for each segment by feeding current to the base 50 of one of the transistor 32 through its associated resistor 48. As current begins to flow, it builds up exponentially against the back e.m.f. generated by the 12 millihenry inductance of the drive coils 12 towards a steady state level of approximately 833 ma. in each coil determined by the coil resistance of 12 ohms, and voltage drops across the circuit components 20, 28, 32 and 38 which in the typical case illustrated total approximately 2.0 volts at the required individual drive coil current of 500 ma. The diodes 28 provide isolation between digits so currents flow only in the coils selected by transistors 20, 40 in the digit selected by external control 18. Under conditions described above, when the current reaches approximately 500 ma. in each driven coil, therefore, the summation of the seven (7) coil currents ($7\times550=3850$ ma.) passing through the current sense resistor 38 generates 0.385 volts to the input 53 of the comparator 52. This equals the current reference voltage to the input 56 of the comparator 52, which causes the comparator output to rise from less than 0.1 volts to more than 4.5 volts. The voltage rise is fed back to the input through the divider action of the resistors 54, 66 to reinforce the comparator's change in state from near ground (OV) the approximately 5 volts. The comparator output 68 connects out to the input of an Intel 8748 Computer external control. The computer is programmed such that a positive logic level at this input ($T_0$) immediately drives the signal output on the selected digit line of Port 1. This digit drive line thus rises instantly to $+V_s$ causing the digit drive transistor 20 to turn off the voltage supply to the drive coils 12. The inductances of the coils maintain an exponentially decaying current flow through diodes 28, segment drive transistors 32, the resistor 38 to ground and the diode 26 until the current through resistor 38 decays to 3150 ma., sufficient to overcome the offset voltage feeding back through the resistor 66 to the input 53 of the comparator 52, at which time the comparator output 68 transitions back to its nearground state. This output 68 connects out to the $T_0$ input of the computer external control, which is programmed such that a zero logic level at this input immediately drives to ground the signal output on the selected digit line of Port 1; in turn causing the digit drive transistor 20 to turn out the voltage supply to the drive coils 12. The coil currents again build up and the sequence repeats in a cyclical manner causing coil drive currents to fluctuate closely around the required level of 500 ma for the 160 milliseconds required to drive a digit to a new state. Although an average of $7\times500$ ma. or 3500 ma. flow continuously through the drive coils, the current flow duty cycle (on-time vs. on-time plus off-time) from the voltage source is approximately 63% resulting in an average voltage source current drain of only 2100 ma., which is a current transformation from source to load of 3500:2100, or 166%.

It should be understood, of course that the foregoing disclosure relates to only a preferred embodiment of the present invention, and it is intended to cover all changes and modifications of the example of the invention herein chosen, for the purpose of the disclosure, which do not constitute departures from the spirit and scope of the invention.

What is claimed is:

1. A low current drain circuit for selectively driving a plurality of electromagnetically actuated displays employing a plurality of digits, each of said digits having a plurality of indicator segments, each of said segments having on and off states, each of said states having an energizing coil associated therewith, said segments remaining in their last driven state until driven to their opposite state, said circuit comprising:

an external control means for selectively controlling said on and off states of said indicator segments;

a power drive means responsive to said external control means for providing a drive current through the coils requiring a change of state; and feed-back means for maintaining said drive current within a predetermined value range by alternating the energizing and de-energizing of said external control means.

2. The invention as defined in claim 1 wherein said external control means includes multi-plexing means for controlling the segments on one digit at a time.

3. The invention as defined in claim 1 wherein said feedback means comprises a sense resistor connected in series with all of said coils, the common connection of said coils and said sense resistor providing one voltage input signal to a comparator and the other input signal to said comparator being provided from a constant level voltage source, the output from said comparator providing a control over said external control means for controlling the energization and de-energization of the coils of a segment.

4. The invention as defined in claim 1 wherein the inductance of the energizing coils is used to increase the efficiency with which the drive current is maintained within said pre-determined value range.

* * * * *